United States Patent [19]

Gilbert

[11] Patent Number: 4,845,982

[45] Date of Patent: Jul. 11, 1989

[54] HYDRAULIC CIRCUIT FOR USE IN WIRELINE FORMATION TESTER

[75] Inventor: Gregory N. Gilbert, Houston, Tex.

[73] Assignee: Halliburton Logging Services Inc., Houston, Tex.

[21] Appl. No.: 87,280

[22] Filed: Aug. 20, 1987

[51] Int. Cl.[4] ..... E21B 47/00

[52] U.S. Cl. ..... 73/151; 73/155; 73/152; 166/264

[58] Field of Search ..... 73/151, 152, 153, 155; 175/4, 4.52, 50, 58, 59; 166/100, 264

[56] References Cited

U.S. PATENT DOCUMENTS

| | | | |
|---|---|---|---|
| 3,209,588 | 10/1965 | Terry | 73/152 |
| 3,577,783 | 5/1971 | Whitten et al. | 73/152 |
| 3,653,436 | 4/1972 | Anderson et al. | 166/100 |
| 3,864,970 | 2/1975 | Bell | 73/155 |
| 3,952,588 | 4/1976 | Whitten | 73/155 |
| 4,416,152 | 11/1983 | Wilson | 73/155 |
| 4,483,189 | 11/1984 | Seal | 73/155 |
| 4,593,560 | 6/1986 | Purfurst | 73/155 |
| 4,676,096 | 6/1987 | Bardsley et al. | 166/100 X |
| 4,720,996 | 1/1988 | Marsden et al. | 73/151 X |

*Primary Examiner*—Eugene R. LaRoche
*Assistant Examiner*—Seung Ham
*Attorney, Agent, or Firm*—William J. Beard

[57] ABSTRACT

In a formation tester constructed with an extendable probe driven by hydraulic means, the means being connected to a hydraulic circuit, an improved apparatus is set forth which includes a hydraulic fluid multiplier means. This multiplier means is connected between the pump and the means extending the probe and backup shoes. The multiplier means incorporates a step piston and a large cylinder having a step conforming with the piston. Suitable seals are placed on the piston. The piston drives initially to deliver a high volume low pressure flow to extend rapidly the probe, and completes its operation with a low volume high pressure flow to assure proper setting. This enables more rapid operation and more rapid completion of formation testing.

10 Claims, 1 Drawing Sheet

FIG. 1
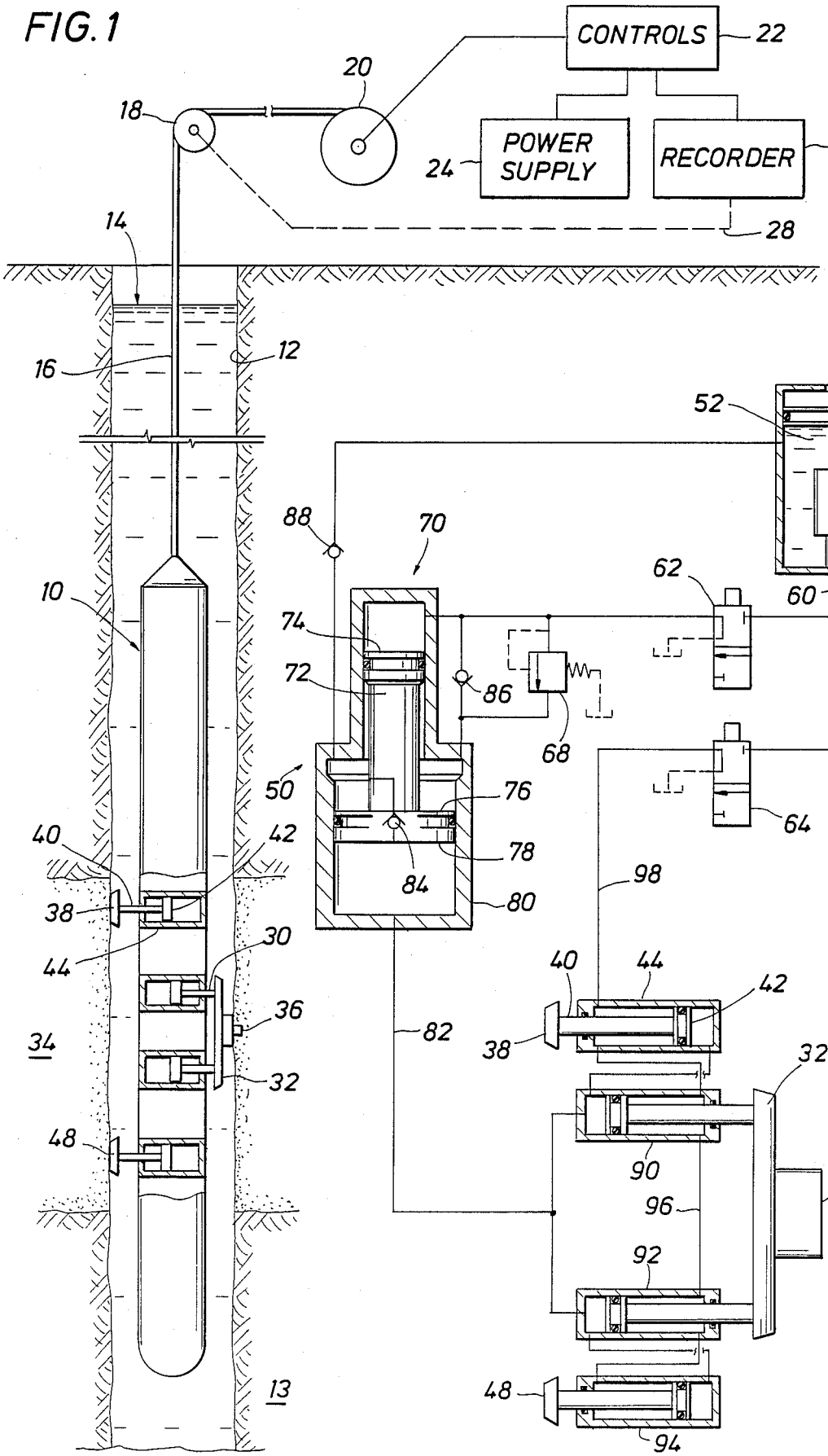
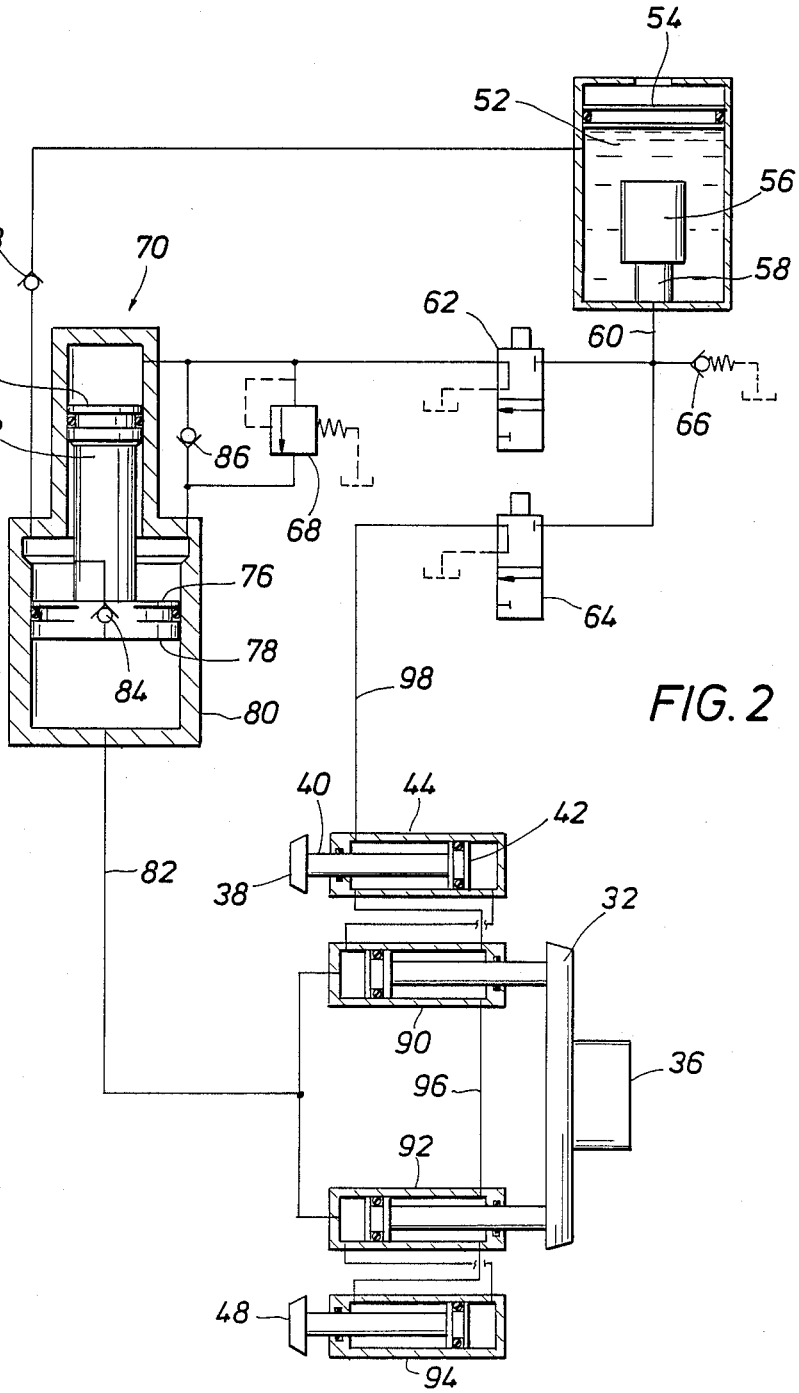
FIG. 2

HYDRAULIC CIRCUIT FOR USE IN WIRELINE FORMATION TESTER

BACKGROUND OF THE DISCLOSURE

After an oil well has been partly drilled and suspected producing formations have been penetrated, it is necessary to make various tests to determine production possibilities of various formations. One of the test techniques involves the use of a tool which is known as a formation tester. An exemplary formation tester is set forth in U.S. Pat. Nos. 4,375,164 and 4,593,560 assigned to assignee of the present disclosure. As set forth in those disclosures, the tool is adapted to be lowered into the well bore, supported on an armored logging cable enclosing certain conductors for providing surface control for the tool. The logging cable extends to the surface and passes over a sheave and is spooled on a reel or drum. The conductors in it connect with suitable surface located power supplies, controls, and recorder. The formation tester is lowered to a specified depth in a well. At that elevation, a backup shoe is extended on one side of the formation tester and formation testing apparatus is extended diametrically opposite into the formation of interest. The equipment so extended normally includes a surrounding elastomeric sealing pad which encircles a smaller extendable snorkel which penetrates a formation as the formation will permit, up to a specified depth. The snorkel is ideally isolated from fluid and pressure in the well to be able to test the formation. The snorkel is extended into the formation to enable direct fluid communication from the formation into the tool. Moreover, it is isolated from invasion of the well borehole fluid and pressures therein to permit a pressure sensor to obtain formation pressure. Further, a sampling chamber elsewhere in the formation tester can be selectively connected through the snorkel by suitable valves to obtain delivery of a fluid sample from the formation. The fluid sample typically may include a relatively small sample which is a pretest sample, and if that is acceptable, a larger sample can be drawn through the snorkel. Various pretest and sample volumes are selected and determined under control from the surface.

Testing procedures require a substantial interval. For instance, isolation steps must be undertaken to assure that the formation tester properly obtains data from a single formation without invasion of other well fluids from different strata. These procedures involve extension and retraction of the packer and snorkel described above. These steps are normally accompanied by the extension of certain backup shoes which set backup shoes on the opposite side of the formation tester in the borehole. Thus, the references noted above describe apparatus which extends the snorkel on one side of the tool body and which extend backup pistons on the opposite side to assure that adequate force is delivered to position the snorkel in the formation of interest.

These procedures require some time to execute. Delay is costly in the performance of such downhole test procedures and equipment. The delay that is encountered in performing such tests translates into added cost. While the cost of rental of a formation tester can be negligible, a far greater cost is the rig time involved during which time the testing procedures are carried out. Ideally, test procedures are conducted as rapidly as possible to assure that the tests are conducted at a minimum cost. As a practical matter, rig time is an increment of cost which can substantially exceed the cost of rental of a formation tester. For these reasons, it is desirable that the formation tester operate as rapidly as possible.

One of the steps carried out by the formation tester is extension of the snorkel and surrounding pad which achieves a seal to isolate the formation. Additionally, backup pistons are extended, thereby assuring that backup shoes are anchored in the well borehole. After this equipment has been extended and after the formation test procedure has ended, the extended equipment is retracted. The snorkel is pulled in and the seal around the elastomeric gasket is normally broken. The backup shoes extended on the opposite side of the testing tool are also retracted.

The present invention is directed to an improved system including a hydraulic circuit within the formation tester which assures that the foregoing movements are carried out as rapidly as possible. That is, the formation testing apparatus is extended and retracted as quickly as possible. This improved apparatus provides a means and mechanism whereby more rapid extension is obtained. This cuts down on the time in which the formation tester is in the borehole. This thereby reduces the test duration and reduces rig time costs. This also reduces the possibility of sticking. It also assures that the extended and retracted equipment is quickly and properly seated to be subsequently retracted. With the foregoing in view, the present apparatus is summarized as a valving system including solenoid valves cooperative with a speed-up mechanism thereby assisting rapid operation of the equipment in the formation tester. Extension of the apparatus is speeded up so that the formation tester can be moved as quickly as possible from location. Further objects and advantages of the present disclosure will become more readily apparent upon consideration of the description of the preferred embodiment set forth below in conjunction with the drawings.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 shows a formation tester suspended in a well borehole for conducting formation tests wherein a snorkel is extended into the formation and backup shoes support the formation tester during the test and further including a tool hydraulic system for operation;

FIG. 2 is a hydraulic schematic showing the improved hydraulic circuit for use in the formation tester of the present invention.

DETAILED DESCRIPTION OF THE PREFERRED EMBODIMENT

Attention is first directed to FIG. 1 of the drawings where the numeral 10 identifies a formation tester constructed in accordance with the teaching of this disclosure. It is supported in a well borehole 12 which is shown to be open hole. The tool 10 typically operates by testing a formation penetrated by open borehole and to this end, no casing has been shown in FIG. 1. Typically, the well is filled with drilling fluid which is known as drilling mud, and the column of drilling mud is identified at 14. The formation tester 10 comprises an elongate cylindrical body of substantial length and weight. It is supported on an armored cable known as a well logging cable. Suitable electrical conductors are enclosed in the cable, the cable being identified by the numeral 16. The cable extends to the surface and passes over a sheave 18. The cable 16 is stored on a drum 20. The cable might be several thousand feet in length to test formations at great depths. Conductors from the cable 16 are connected with various and sundry controls identified at 22. The electronic control equipment and the formation tester are provided with power from a power supply 24. The signals and data obtained from the formation tester 10 are output through the surface located equipment and to a recorder 26. The recorder records the data as a function of depth. An electronic or mechanical depth indicating mechanism is connected to the sheeve 18 and provides depth measurement to the recorder 26 and is thus identified by the numeral 28.

Referring now the tool body, it will be first observed that it supports a laterally extending probe which is identified by the numeral 30. The probe 30 is supported to extend from the tool body. The extended probe is surrounded by a ring of elastomeric material 32. The ring 32 is a seal pad. It is pliable, and is affixed to the probe 30 for sealing operation. Moreover, the ring 32 operates as a seal when pressed against the adjacent formation. Assume the formation 34 adjacent to the tool is suspected to have fluids of interest. This formation 34 is tested by extending a snorkel 36 into the formation. The probe 30 is extended against the formation. When the seal 32 is pressed against the formation 34, the seal prevents invasion of open hole pressure or drilling fluids into the vicinity of the extended snorkel 36. It is important to isolate the snorkel tip from the invading fluids or pressure so that data obtained from the formation 34 is unmodified by the intrusion of a well borehole.

This sequence of operation involving extension of the snorkel 36 into the formation typically occurs after backup shoes and the sealing pad are positioned, and an equalizing valve in the tester is closed. The numeral 38 identifies a top backup shoe which is supported on a piston rod 40. The piston rod 40 extends diametrically opposite the snorkel 36. The snorkel 36 extends on one side of the tool body while the backup shoe is on the opposite side. The piston rod 40 which supports the backup shoe is connected with a piston 42 in a hydraulic cylinder 44. The cylinder is preferably provided with hydraulic for from both ends so that the piston 42 is double acting; that is, the piston rod 40 is extended under power and retracted under power. As will be observed, the backup shoe 38 is above the snorkel 36. A similar backup shoe 48 is also included below the snorkel. Preferably, the backup shoes 38 and 48 are evenly spaced above and below the snorkel 36. Moreover, they are operated by hydraulic power simultaneously applied for extension of the probe 30. This assures that the seal 32 has loading on it to achieve the pressure seal to prevent intrusion of well fluids and pressure into the formation 34. The backup shoe 48 is supported on a similar piston rod and operates in the same fashion, preferably being connected and a parallel with the other backup shoe so that the two operate together.

Attention is now directed to FIG. 2 of the drawings where the numeral 50 identifies the tool hydraulic system. This is carried within the body of the formation tester 10 and operates the equipment partially illustrated in FIG. 1. The hydraulic system 50 incorporates a reservoir 52 which also serves as a return sump. A compensating piston 54 is fluidly communicated with the exterior to convert external pressure into pressure applied to the fluid in the reservoir 52. This establishes the minimum pressure in the hydraulic system. The apparatus further includes a motor 56 which operates a pump 58 for hydraulic fluid. The fluid is delivered over an outlet line 60 and is provided to a first solenoid valve 62 and to a second solenoid valve 64. The valves 62 and 64 are preferably identical and are described as three-way, normally closed valves. The system also includes a high pressure relief valve 66 which has a spring setting which determines the pressure at which pressure is dumped from the line 60.

The solenoid valves 62 and 64 are identical in construction. The valve 62 will be described as the supply valve while the valve 64 will be described as the retraction valve. The logic behind these definitions will be understood more readily hereinafter.

The numeral 68 identifies a priority valve. It operates in conjunction with a fluid multiplier 70. The fluid multiplier 70 includes certain components and check valves to be described. Briefly, it is a movable piston 72 which has a first surface area at the upper end identified at 74. The piston is enlarged and at the opposite end has a surface area which is much greater. The piston has an intermediate step and the step area is identified at 76. The areas 74 and 76 (when added together) equal the surface area 78 at the opposite end. The fluid multiplier 70 has an outlet line 82. The outlet line delivers an increased volume of fluid in the fashion to be described. The cylinder 80 is constructed with uniform diameter along the full length thereof except the very upper end where the diameter is larger; the larger inside diameter forms a fluid bypass from the face 78 to the face 76 to quickly dump fluid around the piston at the end of the upward stroke.

The piston 72 is drilled with an internal passage and a check valve 84 connects across the step. It is constructed with a specific flow direction. It delivers fluid to the lower part of the fluid multiplier.

The supply valve 62 connects to the small end of the fluid multiplier. Additionally, a check valve 86 is connected across the priority valve 68 for flow in a particular direction. In fact, the check valve 86 can deliver flow from the intermediate chamber in the fluid multiplier. Likewise there is an additional check valve 88 connected from the sump. It connects to the intermediate region of the fluid multiplier.

As further shown in FIG. 2 of the drawings, the line 82 extends to a first hydraulic means 90 for extending the probe 30. A second and identical hydraulic means 92 is also included. They are spaced from one another to assure that the probe extends evenly. Moreover, they provide adequate extension and power for fastening the probe into the formation. In like fashion, the cylinder and piston arrangement at 90 is connected and parallel with the cylinder 44 for operation. A duplicate of this is provided for the backup shoe 48. Thus, the hydraulic means 92 is parallel to a similar hydraulic mechanism 94 which extends the backup shoe 48. The setting line 82 is input to one side as illustrated in FIG. 2, thereby causing extension. In similar fashion, a retraction line 98 is connected between the various hydraulic means at 96, and extends to the retraction valve 64. This enables fluid to be returned to sump.

OPERATION OF THE PREFERRED EMBODIMENT

While the foregoing describes the arrangement of the hydraulic schematic shown in FIG. 2, better understanding will be obtained on a review of the sequence of operation. Assume that the formation tester shown in FIG. 1 had been lowered to a formation which is to be tested. At this point, this equipment is operated in the following fashion. Assume that pressure within the borehole is a specified established level determined by the mud column in the borehole. This acts through the compensating piston 54 shown in FIG. 2. The motor 56 is operated which in turn operates the pump 58 and delivers hydraulic fluid under pressure through the line 60. The valve 62 is then operated by suitable signals provided to the solenoid valves and high pressure hydraulic fluid is delivered to the priority valve 68. The fluid is also delivered to the fluid multiplier 70. The influx of fluid under pressure into the small chamber adjacent to the relatively small piston area 74 starts the piston 72 moving. Because there is a difference in surface areas, a small stroke of the piston 72 results in a large volumetric flow of hydraulic fluid through the setting line 82. This is delivered with a sufficient volumetric flow that rapid extension of the means 90, 92, 94 and 44 are accomplished. This assures prompt setting of the probe 30 and the backup shoes 38 and 48 which operate in response to the common delivery of hydraulic fluid under pressure from the fluid multiplier 70. Moreover, when fluid is delivered to the small piston face 74 and exceeds a required value, pressure fluid is then additionally delivered through the priority valve. This pressure change is observed at the intermediate area within the cylinder and acts on the face 76. There is the possibility that a fluid pressure reduction is initially observed above the piston face 76. If that occurs, fluid is delivered through the check valve 88. Recall that the initial pressure is delivered to the small face 74. The check valve 88 thus helps deliver more fluid from the pressure compensated hydraulic reservoir system. This assures that reduced pressure is not sustained in this region.

As will be observed, an initial force is applied to the small face 74. The piston drives the larger face 78. The priority valve experiences something of a reduced pressure and does not open at the time that pressure is first applied to the face 74 of the piston 72. As the probe 30 extends and encounters greater resistance, pressure increases in the setting line 82 which is reflected back to the smaller sides of the piston 72. Thus, pressure observed at the priority valve increases markedly and the priority valve is then forced open. When it opens, it delivers fluid to the intermediate face 76. In other words, high pressure is now delivered to the face 76 and the double faced piston 72 is then exposed to a common pressure on both faces 74 and 76. This assures that the final pressure applied through the setting line is the maximum pressure required for operation. In other words, prompt setting is initiated at high speed but the final incremental movement to achieve setting is accomplished under relatively high pressure. The check valve 84 supplies fluid from the piston face 76 to the face 78 during the setting or extension operation if for some reason the piston 72 has reached its full travel before the setting pistons have reached their full travel.

Now, when it is time to retrieve the formation tester 10 from the borehole, a suitable signal is applied to the solenoid valves 62 and 64. Recall that the valve 64 is the retraction valve. It is moved by suitable solenoid signal to the switched position. This delivers pump pressure through the retraction line 98. This drives all four of the hydraulic mechanisms in the opposite direction. That is, the probe 30 is retracted by the two means that operate the probe while the two backup shoes 38 and 48 are also retracted. At this moment, the setting line 82 is then used as a return line for fluid to sump. Before this begins, the piston 72 is at the downward position. It is forced upwardly. The line 82 thus delivers fluid into the fluid multiplier. Any surplus fluid above the piston is also expelled through the check valve 86 which then delivers fluid through the valve 62 and to sump. This enables the piston 72 to move to the upper end of its stroke. The last part of movement is accomplished by the fluid bypassing the piston 72 when the enlarged upper end of the cylinder is entered.

The foregoing describes the hydraulic circuit and sets forth the mode of operation of the fluid multiplier 70. An important feature of this apparatus is that high speed movement is obtained at the beginning stroke of the various hydraulic rams shown in FIG. 2. When they encounter resistance, the speed may slow down but the pressure then builds up to assure proper and adequate setting. This is desirable also because it helps properly drive the probe through the mud cake in the well borehole and also assures proper penetration of the snorkel to obtain test data from the formation of interest.

The present invention thus provides marked improvement in setting time. This improvement translates into reduced time in which the apparatus is downhole and reduces rig time. The accelerated operation of the equipment reduces the time in which the formation tester is downhole. This is achieved with more rapid setting of the probe to enable subsequent penetration by the snorkel.

While the foregoing is directed to the preferred embodiment, the scope thereof is determined by the claims which follow.

What is claimed is:

1. For use in a formation tester supported on a well logging cable and suspended in a well borehole, a formation tester having an extendable probe therein wherein the probe is extended by operation of a hydraulic circuit, and the hydraulic circuit comprises:

(a) a hydraulic fluid pump for delivering hydraulic fluid under pressure:

(b) hydraulically powered means for extending a probe in the formation tester toward a formation to be tested; and (c) hydraulic fluid multiplier means connected to said pump and to said hydraulically powered means, said multiplier means being constructed and arranged to deliver hydraulic fluid at an initial high volume, low pressure flow having a peak rate of flow to initiate operation of said hydraulic means for moving said probe, said multiplier means further being constructed to have a final low volume, high pressure flow for providing a sufficiently high hydraulic pressure to complete setting of said probe.

2. The apparatus of claim 1 wherein said multiplier means includes a small chamber therein, a large chamber therein, and a piston means therebetween, and wherein said large chamber is connected to said hydraulically powered means.

3. The apparatus of claim 1 including a return line from said hydraulically powered means to sump, and control valves operatively connect a setting line and a retract line to said hydraulically powered means to operate.

4. The apparatus of claim 1 including a pair of double acting pistons within cylinders therefor, said pair being constructed and arranged to extend said probe.

5. The apparatus of claim 4 including solenoid controlled valves for regulating flow through said setting line and retraction line.

6. The apparatus of claim 1 wherein said multiplier means includes:

(a) a piston with
  (1) a small first face,
  (2) a second face,
  (3) a third face having an area equal to the sum of said first and second faces;

(b) a cylinder receiving said piston therein and having
  (1) a small first chamber for receiving fluid pressure acting against said first face,
  (2) a second chamber for receiving fluid pressure acting against said second face,
  (3) a third chamber for receiving fluid pressure acting against said third face;

(c) a flow line connecting said fluid pump to said first chamber;

(d) a setting line extending from said third chamber to said powered means for delivering fluid under pressure thereto;

(e) check valve means opening into said second chamber for
  (1) draining said second chamber on retraction of said powered means,
  (2) filling said second chamber on extension of said powered means, and
  (3) providing pressure fluid flow from said second chamber to said third chamber and into said setting line on full piston travel in said cylinder.

7. The apparatus of claim 6 wherein said piston seals in said cylinder to isolate said first, second and third chambers.

8. The apparatus of claim 7 wherein said piston includes a check valve therein connected to flow pressure fluid from said second chamber to said third chamber.

9. The apparatus of claim 8 including a priority valve connected to deliver pressure fluid from said fluid pump to said second chamber during extension of said powered means.

10. A method of setting and retrieving a formation tester in a well which comprises the steps of:

(a) extending a probe laterally from a tool body to conduct formation testing;

(b) wherein the step of extending is initiated by a hydraulic means and the hydraulic means is driven initially by a high volume low pressure flow of hydraulic fluid for an initial rapid move, and wherein the flow is at reduced volume and increased pressure to complete extension and setting of said probe; and (c) after operation, retracting said probe by providing hydraulic fluid thereto for a retraction stroke to disengage the probe from formation testing.

* * * * *